US005471014A

United States Patent [19]

Green

[11] Patent Number: 5,471,014

[45] Date of Patent: Nov. 28, 1995

[54] INSULATED ELECTRICAL CONDUCTOR CONTAINING FREE-FLOWING MICA

[76] Inventor: Edward A. Green, 4419 State Rte. 82, Mantua, Ohio 44255

[21] Appl. No.: 36,170

[22] Filed: Mar. 24, 1993

[51] Int. Cl.[6] ..... H01B 7/00

[52] U.S. Cl. ..... 174/124 R; 156/53; 174/118; 427/459; 427/472

[58] Field of Search ..... 174/124 R, 124 G, 174/124 GC, 110 R, 118, 120 R, 120 C, 121 R, 121 A, 122 R, 122 C; 336/96, 94; 156/51, 53, 56, 283; 29/527.2, 825; 310/43, 44, 45; 427/457, 458, 459, 462, 472, 212, 213

[56] References Cited

U.S. PATENT DOCUMENTS

| | | | |
|---|---|---|---|
| 3,649,744 | 3/1972 | Coleman | 174/107 |
| 3,717,720 | 2/1973 | Snellman | 174/131 A |
| 3,930,915 | 1/1976 | Mendelsohm et al. | 156/53 |
| 4,204,181 | 5/1980 | Smith et al. | 336/96 |
| 4,265,672 | 5/1981 | Walton et al. | 106/115 |
| 4,439,255 | 3/1984 | Imari et al. | 156/49 |
| 4,526,735 | 7/1985 | Norota et al. | 264/27 |
| 4,653,851 | 3/1987 | Pedersen et al. | 350/96.23 |
| 4,723,083 | 2/1988 | Elton | 310/45 |
| 4,724,345 | 2/1988 | Elton et al. | 310/45 |
| 5,075,514 | 12/1991 | Hurd | 174/117 F |
| 5,227,586 | 7/1993 | Beauchamp | 174/122 R |
| 5,274,196 | 12/1993 | Weinberg | 174/121 R |

*Primary Examiner*—Kristine L. Kincaid
*Assistant Examiner*—Christopher Horgan
*Attorney, Agent, or Firm*—Albert E. Chrow

[57] ABSTRACT

An electrical conductor (100) is provided that is insulated with at least one layer of fibrous material (16') and has free-flowing powdered mica (8) disposed about an electrical conductor (2'). Insulated conductor (100) combines high temperature resistance with flexibility and is preferably made by a fluidized bed and/or electrostatic deposition or spray process.

10 Claims, 2 Drawing Sheets

INSULATED ELECTRICAL CONDUCTOR CONTAINING FREE-FLOWING MICA

INTRODUCTION

This invention relates generally to an insulated electrical conductor containing mica and more particularly to an electrical conductor insulated with at least one layer of fibrous material and having free-flowing powdered mica deposited about the conductor providing the insulated conductor with high temperature resistance as well as flexibility retention.

BACKGROUND OF THE INVENTION

Certain inorganic materials have been used in electrical wire and cable constructions to provide high temperature resistance and/or high voltage ratings for many years with mica (a silicate mineral) being perhaps the most commonly used.

Mica is generally found as platlets or flakes that are extremely fragile and are sometimes pulverized into a powder for particular uses. Because of such fragility, mica flakes or platlets have been heretofore fabricated into a "mica paper" that is bonded to a flexible backing such as a high temperature resistant fibrous material like fiberglass or paper tape by means of a high temperature resistant adhesive such as a curable silicone based adhesive. The use of such backing tapes enables mica to be applied to electrical wire and cable products in a manufacturing setting. Unfortunately, mica, even though bonded to such tapes, tends to crack upon being wrapped or folded about smaller diameter conductors or when the finished product is flexed or bent.

Another disadvantage associated with mica tapes is that they are not generally commercially available in long lengths resulting in costly and time consuming stoppages for splicing tape ends together in order to make long length electrical wire or cable products which in itself creates unevenness in the region of the splices.

Another disadvantage with the use of such mica backed tapes is that the adhesives bonding the mica to the fibrous material characteristically harden when subjected to heat causing the insulated wire or cable to stiffen considerably.

An example of the use of mica backing tapes in the windings of an electrical coil is disclosed in U.S. Pat. No. 4,204,181, the disclosure of which is incorporated herein by reference.

Although powdered mica has been used in electrical products in the past, it has always been blended into a binder or adhesive of some type that are characteristically curable and tend to harden and stiffen when subjected to heat as in the case of the mica backed tapes. An example of the use of powdered mica in a curable binder for an electrical article is disclosed in U.S. Pat. No. 3,930,915, the disclosure of which is incorporated herein by reference.

Even where flaked mica has been electro-deposited upon a conductor in the past, it has been in combination with a curable resin which again tends to harden and stiffen when subjected to heat and of which examples are disclosed in U.S. Pat. Nos. 4,723,083 and 4,724,345, the disclosures of which are incorporated herein by reference.

The present invention eliminates the heretofore described disadvantages associated with the use of mica backed tape and binder/powdered mica in wire an cable products by providing a free-flowing mica about the conductor to provide a high temperature resistant product that remains flexible when subjected to heat.

Another advantage that arises is that when the fibrous material in close proximity to the electrical conductor is fiberglass, the strippability of the fiberglass from the conductor can be enhanced by treating the fiberglass with a solution containing sodium silicate and then heat aging the treated material as disclosed in my co-pending application Ser. No. 08/036,382 entitled "Strippable Fiberglass Insulated Conductor", filed on the same date as this application.

SUMMARY OF THE INVENTION

Accordingly, it is an object of this invention to provide an electrical product that utilizes powdered mica.

It is another object of this invention to provide an insulated electrical conductor containing free-flowing powdered mica.

It is still another object of this invention to provide an insulated electrical conductor containing free-flowing powdered mica that remains flexible when subjected to heat.

It is another object of this invention to provide preferred methods by which to make an insulated electrical conductor containing free-flowing powdered mica that remains flexible when subjected to heat.

DESCRIPTION OF SOME PREFERRED EMBODIMENTS

Figure 1:
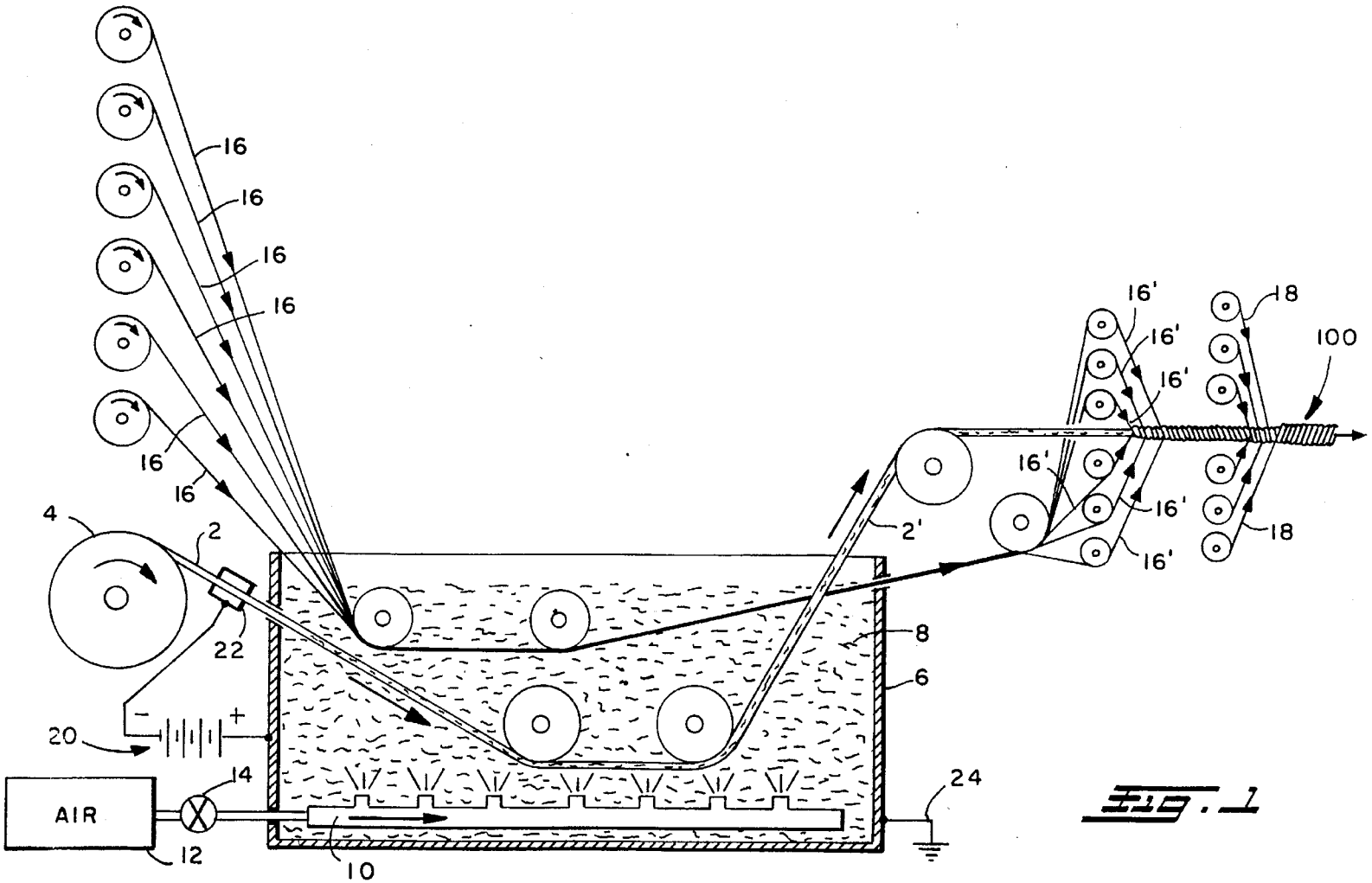
FIG. 1 is a side elevation schematic view of some preferred methods by which the insulated electrical conductor 100 of the invention can made.

In FIG. 1, an electrical conductor 2 is being un-reeled from a spool referenced by numeral 4 as it is pulled through a tank 6 containing powdered mica referenced by numeral 8.

Powdered mica having a particle diameter ranging from about 5 microns to about 90 microns has been found to be particularly effective for purposes of the present invention.

Pressurized air is received by an air distribution device 10 near the bottom of tank 6 from a pressurized air source referenced by numeral 12.

A control valve 14 is provided to control the flow rate of pressurized air through distribution device 10 from pressurized air source 12 . Air rising upwardly through powdered mica 8 creates a fluidized bed of mica that is in constant motion.

Although in the preferred embodiment only the conductor need be pulled through the fluidized bed of mica 8, a plurality of fibrous yarns (referenced by numeral 16) are also being pulled through the fluidized bed of mica 8 to illustrate that either or both fibrous yarn 16 or conductor 2 may be pulled through the fluidized bed. Various rollers and the like (not referenced) may be employed to direct conductor 2 and yarns 16 as they pass through the fluidized bed of mica 8 resulting in yarns 16' being disposed in close proximity to conductor 2' with the prime notations indicating that they both are carrying powdered mica 8 from tank 6.

As previously described, fibrous yarn 16 is preferably a fiberglass yarn in order to combine the high temperature resistance properties of both mica and fiberglass.

Conductor 2 is made from a metal having high electrical conductivity such as copper or combination of conductive metals or non-metals loaded with carbon or graphite or the like. Conductor 2 may be solid or have a stranded construction depending upon the flexibility and performance characteristics desired.

It has been found that an immersion time of about 2 seconds in a fluidized bed of mica 8 is effective in providing the amount of free-flowing mica in close proximity to conductor 2.

It has also been found that an air pressure of about 3 psig is effective in providing a fluidized bed depth of about 5 inches over an area of about 22 square inches.

After fibrous yarn 16' (carrying powdered mica 8) emerges from tank 6, it is disposed in close proximity to conductor 2' (also carrying powdered mica 8) such as by being spiralled about conductor 2' either all in the same winding direction or more commonly with half the total yarns being respectively wound in opposite overlapping directions.

Additional layers of either or both metal or fibrous yarns or tape referenced by numeral 8 may be disposed about the inner layer of fibrous yarn 16' in close proximity to conductor 2' resulting in an insulated electrical conductor 100 having free-flowing mica about conductor 2.

An alternate method for making an insulated electrical conductor in accordance with the invention is to pass only the fibrous yarns through the fluidized bed of mica and not electrical conductor 2 or vice versa as previously described.

Figure 2:
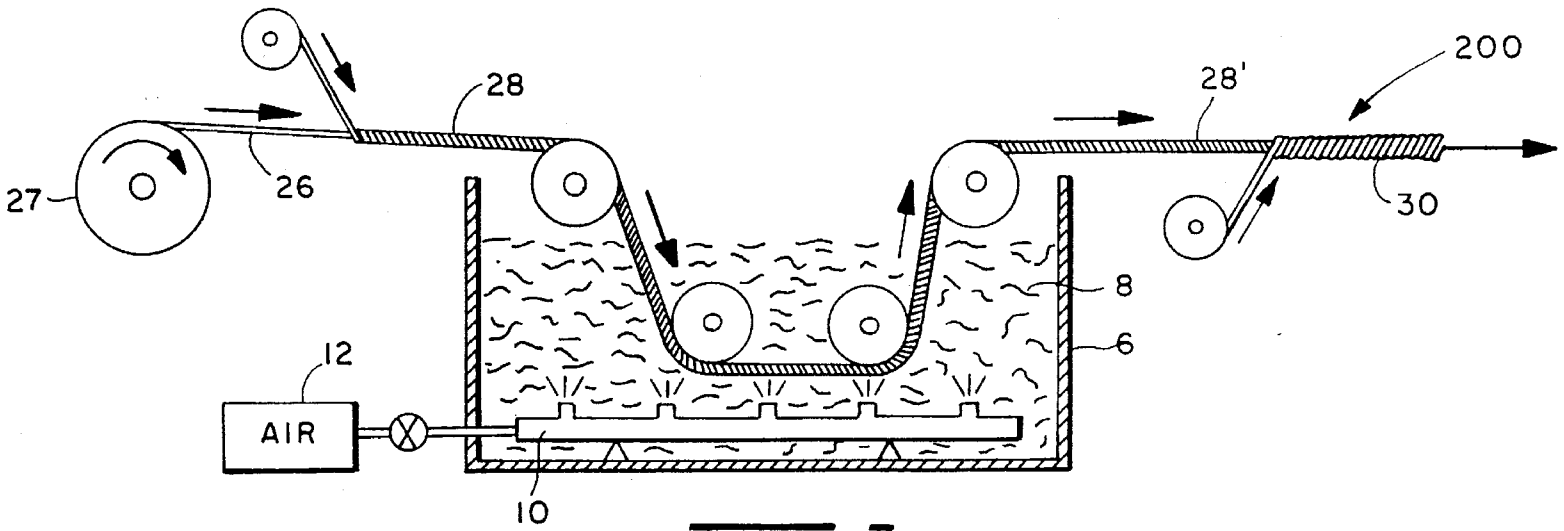
FIG. 2 is a side elevation view of another embodiment of the insulated electrical conductor of the invention referenced by numeral 200.

Yet another method for making an insulated electrical conductor in accordance with the invention is referenced by numeral 200 in FIG. 2 where an electrical conductor 26 while, being pulled from reel 27 is first covered with a spiral wrapper of fibrous yarn 28 before being pulled through tank 6 containing a fluidized bed of powdered mica 8. Mica 8 is kept in constant motion by means of a pressurized air source 12 that is distributed by a suitable distribution device 10 previously described.

In this case, conductor 26 encompassed by a wrapping or layer of fibrous yarn is pulled through the fluidized bed of mica 8 and the mica coated yarn 28' emerging from tank 6 is then surrounded by a wrapping of fibrous yarn referenced by numeral 30.

The embodiment of the invention referenced by numeral 200 illustrates that the powdered mica need not be in direct contact with the conductor and may be separated therefrom by one or more layers of fibrous insulating material such as fiberglass.

Another method by which to make an insulated electrical conductor in accordance with the invention is by electrostatic deposition which is illustrated in FIG. 1 and which may be undertaken while the mica is contained in a fluidized bed with the pressurized air flow on or alternately as a non-fluidized bed with the pressurized air flow turned off or otherwise in a tank that is not provided with means for creating a fluidized bed.

An electromotive force moving powdered mica 8 towards and holding mica 8 onto the outer surface of conductor 2 is created by applying a direct current voltage potential between tank: 6 and conductor 2 by means of a battery or suitable DC converter from an alternating voltage source referenced by numeral 20. In such case, tank 6 or, at least the inner surface of a non-conductive tank 6 in contact with mica 8, is made from an electrically conductive material that is grounded such as referenced by numeral 24.

Conductor 2 is connected to the negative terminal of direct voltage source 20 by any suitable method such as passing conductor 2 through an electrical contacting device referenced by numeral 22 which provides a suitable type of sliding electrical contact with conductor 2 such as by means of flexible metallic chains well known to those skilled in the art.

The positive side of direct voltage source 20 is connected to tank 6 as previously described, although a range of voltage may be employed, a direct voltage source of about 10,000 static volts has been found to be effective for an immersion time for mica 8 in tank 6 of about one-half second.

In the case of electrostatic deposition, either conductor 2 alone or the combination of conductor 2 and fiberglass yarn 16 pass through powdered mica 8 which may be in a static state or fluidized bed state as previously described.

Figure 3:
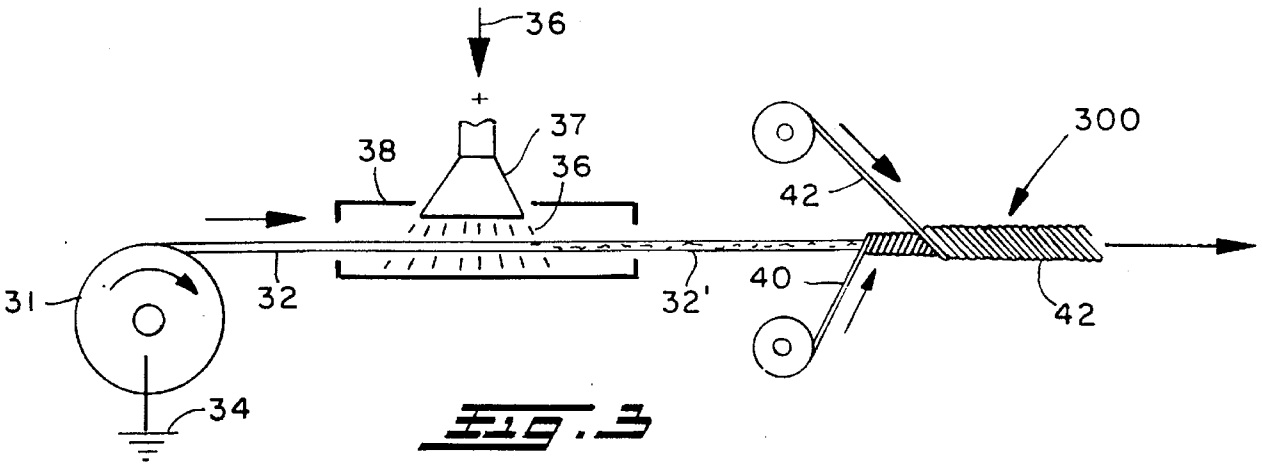
FIG. 3 is a schematic side elevation view of an electrostatic spray method of making the insulated electrical conductor of the invention referenced by numeral 300.

Still another method by which to make an insulated electrical conductor in accordance with the invention is referenced by numeral 300 in FIG. 3. In this method an electrical conductor 32 is pulled from reel 31 through an electrostatic spray booth referenced by numeral 38. Conductor 31 passes below an electrostatic spray head 37 that directs electrically charged particles of powdered mica 36 onto conductor 32 to provide powdered mica coated conductor 32' about which is wrapped fibrous yarns 40 and 42 in opposite winding directions to provide insulated electrical conductor 300.

In this method or process, conductor 32 is electrically grounded as referenced by numeral 34 and powdered mica 36 is electrically charged at about 50,000 static volts and blown onto conductor 32 by a suitable pressurized air source.

Insulated electrical conductors made in accordance with the invention thus comprise an electrical conductor having at least one layer of fibrous insulating material and free-flowing powdered mica disposed thereabout. The mica is preferably in close proximity to the conductor such as being deposited between the conductor and the fibrous insulation but also may be disposed about at least one layer of fibrous material that is first disposed about the conductor.

The insulated electrical conductor of the invention may include additional layers of fibrous and/or metallic insulation and/or protective coverings as may be required for particular applications.

What is claimed is:

1. An electrical conductor insulated with at least one layer of fibrous material and having free-flowing mica devoid of binder disposed about the layer of fibrous material.

2. The conductor of claim 1 wherein the fibrous material is fiberglass.

3. A method for providing an electrical conductor insulated with at least one layer of fibrous material and having free-flowing powdered mica devoid of binder disposed about the conductor, said method comprising the steps of:

passing the conductor through a fluidized bed of powdered mica; and then encompassing the mica coated conductor with the fibrous material.

4. A method for providing an electrical conductor insulated with at least one layer of fibrous material and having free-flowing powdered mica devoid of binder disposed about the conductor, said method comprising the steps of:

passing both the conductor and the fibrous material through a fluidized bed of the powdered mica; and then encompassing the mica coated conductor with the mica bearing fibrous material.

5. A method for providing an electrical conductor insulated with at least one layer of fibrous material and having free-flowing powdered mica about the conductor, said method comprising the steps of:

,encompassing the conductor with the fibrous material; and then passing the fibrous covered conductor through a fluidized bed of the powdered mica devoid of binder.

6. The method of claim 3, 4 or 5 wherein an electromotive force electrostatically deposits the powdered mica about the conductor while passing through the fluidized bed.

7. The method of claim 3, 4 or 5 wherein the fibrous material is fiberglass.

8. A method for providing an electrical conductor insulated with at least one layer of fibrous material and having free-flowing powdered mica devoid of binder disposed about the conductor, said method including the steps of:

electrostatically depositing the powdered mica on the conductor, and then encompassing the conductor with the fibrous material.

9. The method of claim 8 wherein the fibrous material is fiberglass.

10. The method of claim 8 wherein the powdered mica is electrostatically sprayed on the conductor.

* * * * *